US005614924A

United States Patent [19]

Numao

[11] Patent Number: 5,614,924

[45] Date of Patent: Mar. 25, 1997

[54] FERROELECTRIC LIQUID CRYSTAL DISPLAY DEVICE AND A DRIVING METHOD OF EFFECTING GRADATIONAL DISPLAY THEREFOR

[75] Inventor: Takaji Numao, Kashiwa, Japan

[73] Assignee: Sharp Kabushiki Kaisha, Osaka, Japan

[21] Appl. No.: 437,441

[22] Filed: May 4, 1995

[30] Foreign Application Priority Data

Jun. 1, 1994 [JP] Japan ..... 6-120324

[51] Int. Cl.[6] ..... G09G 5/10

[52] U.S. Cl. ..... 345/149; 345/89; 345/147

[58] Field of Search ..... 345/149, 147, 345/152, 100, 89, 94, 95, 96, 97, 99, 148, 103, 81

[56] References Cited

U.S. PATENT DOCUMENTS

| | | | |
|---|---|---|---|
| 5,146,213 | 9/1992 | Brunel et al. | 345/147 |
| 5,404,236 | 4/1995 | Hartmann et al. | 345/149 |
| 5,436,747 | 7/1995 | Suzuki | 345/149 |
| 5,459,495 | 10/1995 | Scheffer et al. | 345/89 |
| 5,477,235 | 12/1995 | Numao | 345/97 |

FOREIGN PATENT DOCUMENTS

| | | |
|---|---|---|
| 0316822 | 5/1989 | European Pat. Off. . |
| 0361981 | 4/1990 | European Pat. Off. . |
| 0379810 | 8/1990 | European Pat. Off. . |
| 0543447 | 5/1993 | European Pat. Off. . |
| 1-61180 | 3/1989 | Japan . |
| 2-96118 | 4/1990 | Japan . |
| 3-189622 | 8/1991 | Japan . |
| 5-119327 | 5/1993 | Japan . |

OTHER PUBLICATIONS

Patent Abstracts of Japan, vol. 015, No. 449 (p. 1275), 14 Nov. 1991 and JP–A–03 189622 (Citizen Watch Co Ltd) 19 Aug. 1991.

*Primary Examiner*—Jeffery Brier
*Assistant Examiner*—Martin Loui
*Attorney, Agent, or Firm*—David G. Conlin; Brian L. Michaelis

[57] ABSTRACT

A liquid crystal display device includes: a multiple number of scan electrodes disposed parallel to each other; a plurality of signal electrodes disposed parallel to each other and perpendicular to the scan electrodes; and a ferroelectric liquid crystal disposed at crossing points of the scan electrodes and the signal electrodes to form pixels. In the device each of the pixels is provided with a plurality of scan electrodes so as to form a multiple number of sub-pixels constituting the pixel and a pixel dividing device is constructed such that, with a multiple number of scan electrodes A, B and C (three or more) constituting a single pixel, a line width ratio A:B:C of the scan electrodes is 1: $N^P$–1:1 (N and P are integers of 2 or more) and these scan electrodes are displayed always in the order of A→B→C. Further, a gradational display based on the pixel dividing method is constructed such that independent, different selected voltages are applied simultaneously and directly to a multiple-number of the scan so that different voltages may be provided to sub-pixels composed of the electrodes and a single signal electrode, whereby switching of the ferroelectric liquid crystal can be controlled.

12 Claims, 13 Drawing Sheets

FERROELECTRIC LIQUID CRYSTAL DISPLAY DEVICE AND A DRIVING METHOD OF EFFECTING GRADATIONAL DISPLAY THEREFOR

BACKGROUND OF THE INVENTION (1) Field of the Invention

The present invention relates to a ferroelectric liquid crystal display device with each pixel divided into sub-pixels and more particularly relates to a method of displaying gradations in the apparatus.

(2) Description of the Prior Art

As a method of displaying tonal gradations in a liquid crystal display device using a ferroelectric liquid crystal, a pixel dividing method is disclosed in Japanese Patent Application Laid-Open Hei 2 No.96118 in which pixels are each composed of a multiple number of sub-pixels using plural scanning electrodes and plural signal electrodes for each pixel so that each sub-pixel can individually be driven whereby gradations are displayed for each pixel. According to this method, it is possible, as shown in FIG. 1, to prevent neighboring pixels from forming unintentional pairing because the center of each pixel with divided sub-pixels is fixed. In the figure, reference numerals (1) through (16) designate display tonal level numbers for pixels having different on-and-off patterns.

In the ferroelectric liquid crystal display device thus divided, every scan line constituting sub-pixels is provided with a driver circuit so that the driver circuits sequentially sweep the scan electrodes for each pixel. In this case, time required for one pixel to be rewritten becomes long as the number of the scan electrodes for the pixel increases. For example, as comparing the time between the case where no pixel division is made and the case where one pixel is constituted by two scan lines, the latter requires two times longer than the former.

On the other hand, a method is disclosed in Japanese Patent Application Laid-Open Hei 3 No.189622 in which a plurality of scan electrodes are connected to one common driver circuit via different resistors in order to reduce the number of driver circuits. In this method, a multiple number of the scan electrodes can simultaneously be selected and consequently, the number of the scan electrodes increases and this solves the problem that the time required for one pixel to be rewritten becomes long. In this method, ITO electrodes are used as transmission lines in a way. That is, as the resistance of a transmission line becomes great, the phase of an input waveform is delayed more. Therefore, an input applied voltage to one pixel presents different waveforms between at a sub-pixel on a scan electrode connected to a driver via a low resistance and at a sub-pixel on another scan electrode connected to the driver via a high resistance even if the sub-pixels belong to the same pixel. As a result, the display states of the sub-pixels vary depending upon the state of the waveform applied to the signal electrodes. Specifically, both the sub-pixels may be rewritten, either of them may be rewritten, or neither of them may be rewritten.

Since the resistivity of ITO electrodes is typically rather high, a signal provided even for the sub-pixels on the scan electrode which are connected to the driver via an ITO electrode having a relatively low resistance delays in phase, especially at the distally located sub-pixels. Since the signal or waveform appearing on a sub-pixel located on the input side on a scan electrode must be more delayed in phase than the voltage waveform applied to the distally located sub-pixel in order to obtain uniformly gradational display on the panel, the waveform applied to distally located sub-pixels on the scan electrode connected to the driver via the high resistance must further delay in phase. Accordingly, in order to allow the sub-pixel receiving the most delayed waveform in phase to display, a longer scanning time is required for the case of this method as compared to the case where two tones or white and black tones are displayed.

Japanese Patent Application Laid-Open Sho 64 No.61180 discloses a method of displaying in which $2^K$ tones are displayed by time-dividing using pixels which are merely able to effect binary display. In this method, all the scan electrodes for a liquid crystal display device are divided into a plurality of sets, each of which is scanned K-times in the duration of one frame. For example, if $2^3$ levels of tones are to be displayed, all the scan electrodes are divided into a pair of sets. As shown in (1) and (2) in FIG. 2, data on bit 1 is displayed in the first set and then data on bit 2 is displayed in the first set, data on bit 2 is displayed in the second set, data on bit 3 is displayed in the first set, data on bit 1 is displayed in the second set and data on bit 3 is displayed in the second set, whereby eight levels of tones are displayed.

SUMMARY OF THE INVENTION

It is therefore a first object of the present invention to provide a pixel-dividing method for preventing neighboring pixels from forming unintentional pairing, not dependent upon the method of Japanese Patent Application Laid-Open Hei 2 No.96118.

It is a second object of the present invention to provide a method which allows gradational display based on a pixel-dividing technique in equivalent scan time to a case of effecting black-and-white or two tone display. Particularly, the present invention is to provide a method of driving sub-pixels together in a liquid crystal display device with pixels divided into a plurality of sub-pixels, within a driving voltage range as narrow as possible and improving the controllability of display states of the pixels.

It is a third object of the present invention to provide a method of effecting the time-dividing gradational display dependent on Japanese Patent Application Laid-Open Sho 64 No.61180.

The present invention has been achieved in order to attain the above objects and a first feature of the present invention resides in a ferroelectric liquid crystal display device which comprises: a plurality of scan electrodes disposed parallel to each other; a plurality of signal electrodes disposed parallel to each other and perpendicular to the scan electrodes; and a ferroelectric liquid crystal disposed at crossing points of the scan electrodes and the signal electrodes to form pixels, and in which each of the pixels is provided with a plurality of scan electrodes so as to form a multiple number of sub-pixels constituting the pixel, and is constructed such that the plurality of scan electrodes are provided for a single pixel in a line width ratio of 1: $N^P$–1:1 (N and P are integers of 2 or more).

A second feature of the present invention resides in a ferroelectric liquid crystal display device which comprises: a plurality of scan electrodes disposed parallel to each other; a plurality of signal electrodes disposed parallel to each other and perpendicular to the scan electrodes; and a ferroelectric liquid crystal disposed at crossing points of the scan electrodes and the signal electrodes to form pixels, and in which each of the pixels is provided with a plurality of scan electrodes so as to form a multiple number of sub-pixels constituting the pixel, and is constructed such that different voltages are applied simultaneously and independently from one another to the plurality of scan electrodes for a single pixel.

A third feature of the present invention resides in that a driving method of effecting gradational display for a ferroelectric liquid crystal display device comprising: a plurality of scan electrodes disposed parallel to each other; a plurality of signal electrodes disposed parallel to each other and perpendicular to the scan electrodes; and a ferroelectric liquid crystal disposed at crossing points of the scan electrodes and the signal electrodes to form pixels, wherein each of the pixels is provided with a plurality of scan electrodes so as to form a multiple number of sub-pixels constituting the pixel and the plurality of scan electrodes are provided for a single pixel in a line width ratio of 1: $N^P$−1:1 (N and P are integers of 2 or more), comprises the steps of: using the ferroelectric liquid crystal having negative anisotropy of dielectric constant; simultaneously applying different voltage waveforms from each other to separate, plural scan electrodes constituting a single pixel; and applying voltages to signal electrodes corresponding to the scan electrodes in such a manner that, if the display state of a sub-pixel to be impressed with a voltage is to be changed from on state into another state, the voltage to be applied to the sub-pixel takes a waveform of consecutive two homopolar pulses, and if the display state of the sub-pixel is to be unchanged, the voltage to be applied to the sub-pixel takes a waveform of consecutive two heteropolar pulses.

A fourth feature of the present invention resides in that a driving method of effecting gradational display for a ferroelectric liquid crystal display device comprising: a plurality of scan electrodes disposed parallel to each other; a plurality of signal electrodes disposed parallel to each other and perpendicular to the scan electrodes; and a ferroelectric liquid crystal disposed at crossing points of the scan electrodes and the signal electrodes to form pixels, wherein each of the pixels is provided with a plurality of scan electrodes so as to form a multiple number of sub-pixels constituting the pixel and different voltages are applied simultaneously to the plurality of scan electrodes for a single pixel, comprises the steps of: using the ferroelectric liquid crystal having negative anisotropy of dielectric constant; simultaneously applying different voltage waveforms independently from one another to plural scan electrodes constituting a single pixel; and applying voltages to signal electrodes corresponding to the scan electrodes in such a manner that, if the display state of a sub-pixel to be impressed with a voltage is to be changed into other state, the voltage to be applied to the sub-pixel takes a waveform of consecutive two homopolar pulses, and if the display state of the sub-pixel is to be unchanged, the voltage to be applied to the sub-pixel takes a waveform of consecutive two heteropolar pulses.

In the third and fourth features, it is preferable that the integral of voltage with respect to time for an applied waveform to any sub-pixel is made equal for all the voltage waveforms since no d.c. component will be left in the liquid crystal and therefore no characteristic deterioration of the liquid crystal will occur.

In either of the first through fourth configurations above, it is preferable that a liquid crystal display device used is capable of displaying M levels of tones, has all the scan electrodes therein divided into groups of scan electrodes in a number of (1+M)/2 or less, and is constructed such that a certain group of scan electrodes is scanned and subsequently the same group of scan electrodes is scanned, thereafter the remaining groups of scan electrodes are scanned successively because this feature makes it possible to effect time-dividing gradational display at a higher speed.

The present invention is thus configurated in order to attain the above objects described above, and the common feature of the present invention is use of a ferroelectric liquid crystal display device which comprises: a plurality of scan electrodes disposed parallel to each other; a plurality of signal electrodes disposed parallel to each other and perpendicular to the scan electrodes; and a ferroelectric liquid crystal disposed at crossing points of the scan electrodes and the signal electrodes to form pixels, and in which each of the pixels is provided with a plurality of scan electrodes so as to form a multiple number of sub-pixels constituting the pixel.

In order to attain the first object, in the present invention, a multiple number of scan electrodes (three or more) are provided for a single pixel so that a line width ratio of scan electrodes A:B:C is set to be 1: $N^P$−1:1 (N and P are integers of 2 or more) and these scan electrodes are displayed always in the order of A→B→ C.

In order to attain the second object, in the present invention, a means for simultaneously applying different selected voltages, independently from one another to a plurality of scan electrodes for a single pixel is provided so that different voltages can be applied to sub-pixels each composed of the scan electrodes and a single signal electrode to thereby control the switching of the ferroelectric liquid crystal.

In this case, a ferroelectric liquid crystal having negative anisotropy of dielectric constant is preferably used.

In a more preferable configuration of the present invention wherein a plurality of scan electrodes constituting a single pixel are simultaneously applied with different voltage waveforms from one another, signal electrodes which, in cooperation with the scan electrodes, form sub-pixels in the pixel, are impressed with such voltages that sub-pixels to be changed in their display state may be applied with voltage waveforms of homopolar consecutive pulses and sub-pixels to be unchanged in their display state may be applied with voltage waveforms of heteropolar consecutive pulses.

The voltage waveforms applied to the sub-pixels could be different from each other depending upon the display state of the pixel, but it is preferable that the integral of voltage with respect to time for an applied waveform to any sub-pixel is made equal for all the voltage waveforms.

In order to achieve the third object of the present invention, in the above method and the like, using a liquid crystal display device capable of displaying M levels of tones with all the scan electrodes therein divided into groups of scan electrodes in a number of (1+M)/2 or less, a certain group of scan electrodes is scanned from the term t=0 to $T_0$ and subsequently the same group of scan electrodes is scanned from the term t=$T_0$ to $2T_0$, thereafter the remaining groups of scan electrodes are scanned in the similar manner and subsequently the same group of the scan electrodes is scanned again from the term from $MT_0+T_0$ to $MT_0+2T_0$.

According to the first feature of the present invention, when, with a multiple number of scan electrodes A, B and C (three or more) constituting a single pixel, a line width ratio A:B:C of the scan electrodes is 1: $N^P$−1:1 (N and P are integers of 2 or more) and these scan electrodes are displayed, as shown in FIG. 11 which shall be described later, always in the order of A→B→C, it is possible to represent four levels of tones, that is, 0, 1, $N^P$ and $N^P+1$ and the center of display of a pixel $A_{ij}$ moves at most from the scan electrode $L_{iA}$ to the center of gravity of the pixel $A_{ij}$. Thus, every center of display of any pixel on the display panel moves in the same way so that it is possible to prevent neighboring pixels from forming unintended pairing.

In accordance with the second feature of the present invention, since different voltages are applied simultaneously and independently from one another to the plurality of scan electrodes constituting a single pixel, it is possible to apply different voltages from each other to different sub-pixels each composed of one of the scan electrodes and a single signal electrode, whereby the ferroelectric liquid crystal segment for each sub-pixel can be separately switched to effect gradational display.

Particularly, in accordance with the third and fourth feature of the present invention, a ferroelectric liquid crystal molecule receives a force F which is composed of: a first force in proportion to a vector product of the spontaneous polarization $P_s$ perpendicular to the longitudinal direction of the molecule and an electric field E formed by the potential difference between the scan electrode and the signal electrode; and a second force in proportion to a dielectric difference $\Delta\in$ between those in the long axis direction and in the short axis direction and a square of the electric field E. That is, a ferroelectric liquid crystal molecule whose anisotropy of dielectric constant $\Delta\in$ is negative receives a force F represented as follows:

$$F=K_0\times P_s\times E+K_1\times\Delta\in\times E^2$$

This force F becomes maximum where the electric field E is minimum (at a specific minimum electric field $E_{min}$) and becomes small on both sides. The memory pulse width which is required for changing the state of the liquid crystal molecules from one stable condition to the other stable condition takes a minimum value $\tau_{min}$ (minimum memory pulse width) where the electric field becomes minimum or $E_{min}$, and becomes large when the electric filed is greater than $E_{min}$.

If a ferroelectric liquid crystal material having negative anisotropy of dielectric constant is used, the liquid crystal molecules forming a pixel receive the above force in association with the voltage to be applied to the pixel, and the liquid crystal molecules become to have the minimum memory pulse width $T_{min}$ for the specific electric field $E_{min}$.

Further, when a voltage waveform of two consecutive pulses of the same polarity is applied to a pixel, the memory pulse width as well as the minimum memory pulse width $\tau_{min}$ for the voltage applied by the subsequent pulse becomes small as compared to the case where a single pulse is applied to because the first pulse has some influence on the memory pulse width. At that time, the electric field $E_{min}$ at the time of minimum memory pulse width becomes large. On the contrary, when a voltage waveform of two consecutive pulses of the opposite polarities is applied to a pixel, the memory pulse width as well as the minimum memory pulse width $\tau_{min}$ for the voltage applied by the subsequent pulse becomes large as compared to the case where a single pulse is applied to. It is noted that the polarity of the subsequent pulse be set up so as to cause the liquid crystal molecules to change into the other stable condition.

FIG. 3 is an illustrative chart showing relations between voltages and memory pulse widths for both subsequent pulses of the same polarity with a first pulse and subsequent pulses of the opposite polarity to a first pulse. As shown in the chart, the characteristic of the first pulse causes $\tau_{min}$ and $E_{min}$ to vary as stated above. That is, when a homopolar pulse is applied to, the memory state of the ferroelectric liquid crystal can be changed. In contrast, when a heteropolar pulse is applied to, the memory state of the ferroelectric liquid crystal can be inhibited to change. In the above cases, since d.c. components for the both cases can be set equal to each other, when an identical voltage waveform is applied to one or some signal electrodes, in some cases the potential difference between one scan electrode to which a certain selected voltage is applied and one of the above signal electrode presents homopolarity while in other cases, the potential difference between another scan electrode to which another selected voltage is applied and one of the above signal electrode presents heteropolarity, whereby different sub-pixels are simultaneously driven into different desired display states to thereby effect gradational display.

By making equal the integrals of voltage with respect to time for all voltage waveforms, it is possible to easily balance d.c. components through the liquid crystal molecules constituting pixels.

Here, as is understood from the above description, the voltage of a subsequent pulse to a first pulse is preferably greater than a corresponding voltage to $E_{min}$ for the heteropolarity, and more preferably taken smaller than a corresponding voltage to $E_{min}$ for the homopolarity.

In accordance with the present invention, using the liquid crystal display device which is made capable of displaying M levels of tones by the first to fourth features of the present invention, it is possible to divide all the scan electrodes therein into groups of scan electrodes in a number of (1+M)/2 or less, scan a certain group of scan electrodes from the term t=0 to $T_0$ to create a display state 'a', subsequently scan the same group of scan electrodes from the term $t=T_0$ to $2T_0$ to create a display state 'b', thereafter scan the remaining groups of scan electrodes in the similar manner and subsequently scan again the same group of the scan electrodes from the term from $MT_0+T_0$ to $MT_0+2T_0$.

Thus, in the similar manner to the method of Japanese Patent Application Laid-Open Sho 64 No.61180, it is possible to make difference between the initially activated state 'a' and the secondary activated state 'b' by weighing them in a ratio of 1: M and therefore display $M^M$ levels of tones (O-th to $(M^M-1)$-th levels) by using the liquid crystal display device capable of displaying M levels of tones.

DESCRIPTION OF THE PREFERRED EMBODIMENTS

Figure 1:
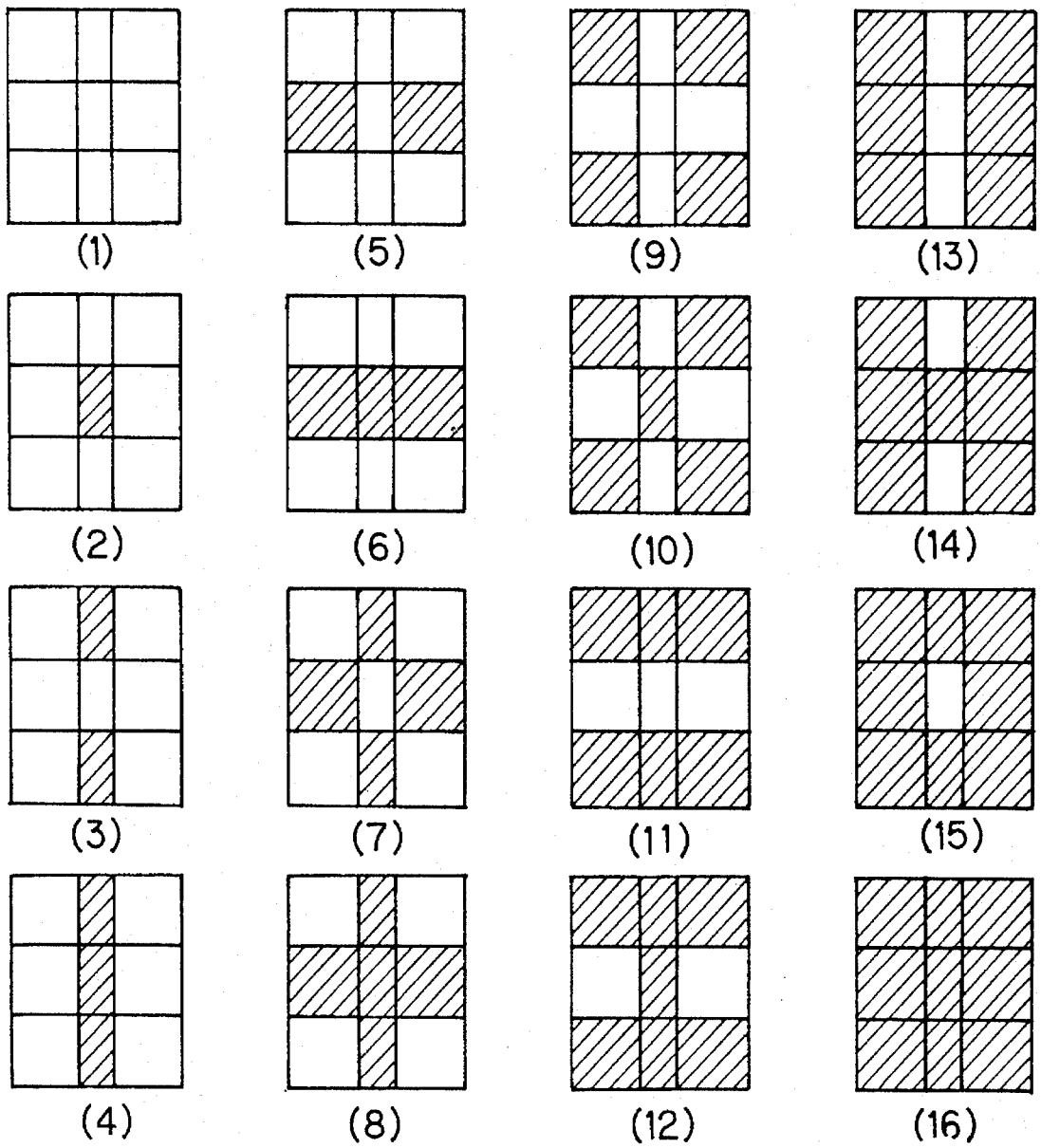
Fig.1 PRIOR ART
FIG. 1 is an illustrative view schematically showing an example of a prior art pixel dividing method.
Figure 2:
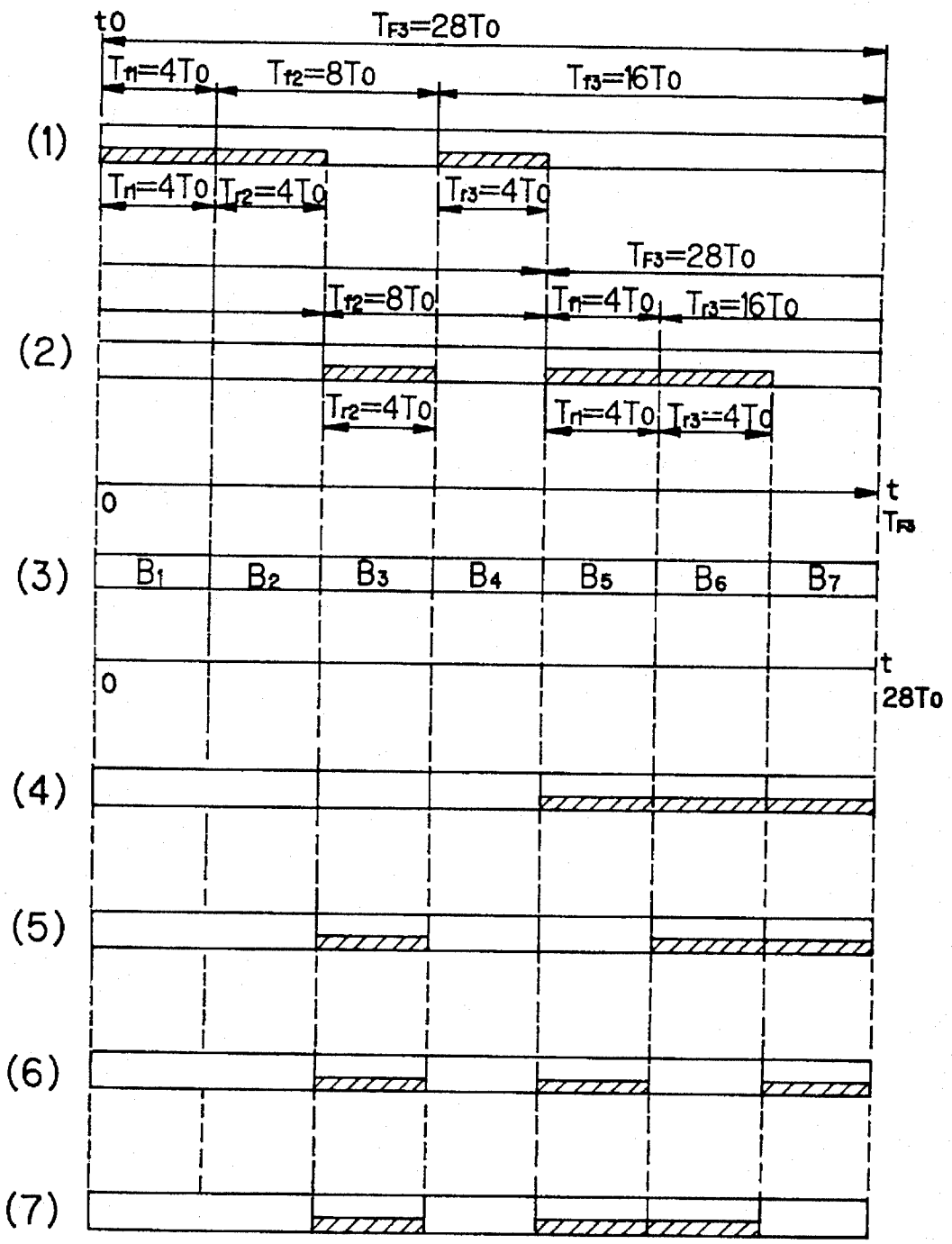
Fig.2 PRIOR ART
FIG. 2 is an illustrative view schematically showing an example of a prior art time dividing method.
Figure 3:
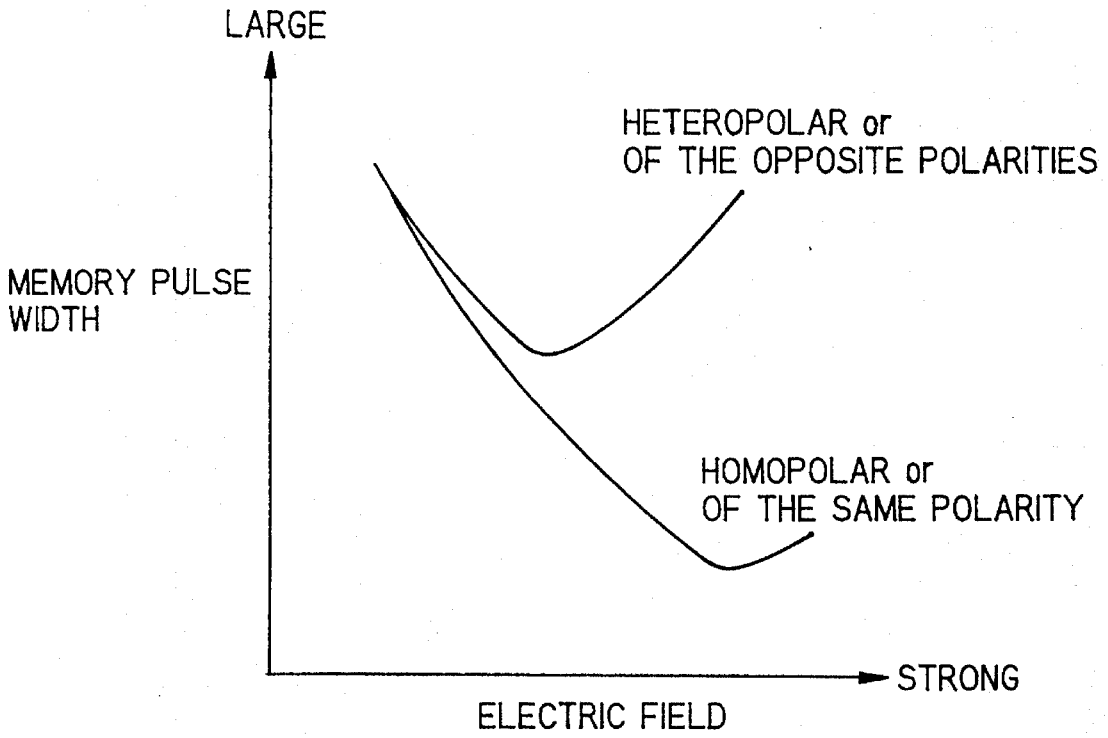
FIG. 3 is a chart showing relations between pulse voltages and memory pulse widths for homopolar pulses and heteropolar pulses when a liquid crystal used has negative anisotropy of dielectric constant.
Figure 4:
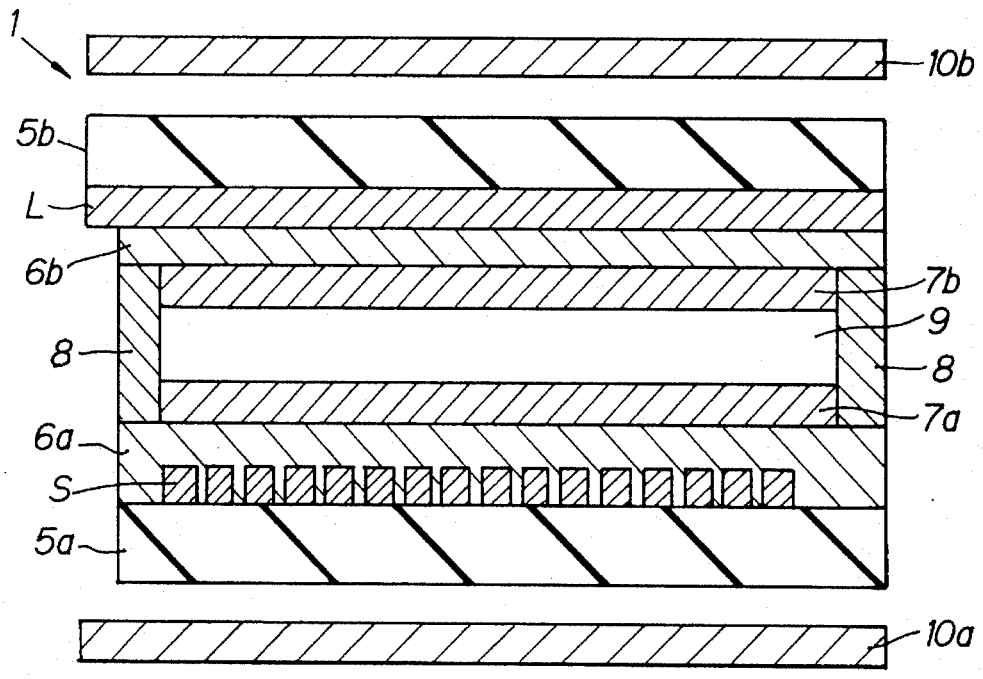
FIG. 4 is a schematic structural view showing a liquid crystal display device commonly used in all the embodiments of the present invention.

FIG. 4 shows a sectional, schematic configuration of a liquid crystal display device 1 commonly used in the present invention. The liquid crystal display device 1 includes a pair of glass substrates 5*a* and 5*b* opposed to each other, and a plurality of transparent signal electrodes S, of indium tin oxides (to be abbreviated as ITO hereinbelow) are arranged parallel to one another on the glass substrate 5*a* and coated thereover with a transparent, insulating film 6*a* made of such as $SiO_2$ etc.

Provided on the surface of the other glass substrate 5*b* opposed to the signal electrodes S, are a plurality of transparent scan electrodes L, of ITO etc., arranged parallel to one another and extending perpendicular to the lengths of the signal electrodes S. These scan electrodes L are further coated thereover with a transparent, insulating film 6*b* made of such as $SiO_2$ etc. Both of the insulating films 6*a* and 6*b* are coated with respective, transparent orienting films 7*a* and 7*b* composed of polyvinyl alcohol etc., with the surfaces thereof treated by the rubbing method and the like. The pair of glass substrates 5*a* and 5*b* are put together with a sealing agent 8 leaving an opening for injection, through which an FLC 9 is charged into a space sandwiched between the orienting films 7*a* and 7*b* by vacuum injection and the like. Then, the opening for injection is hermetically confined by the sealing agent 8.

The thus affixed two glass substrates 5*a* and 5*b* are sandwiched between a pair of polarizing plates 10*a* and 10*b* with their vibration planes crossed at right angles. Here, the distance between the scan electrodes L and the signal electrodes S is 1.5 μm.

Figure 5:
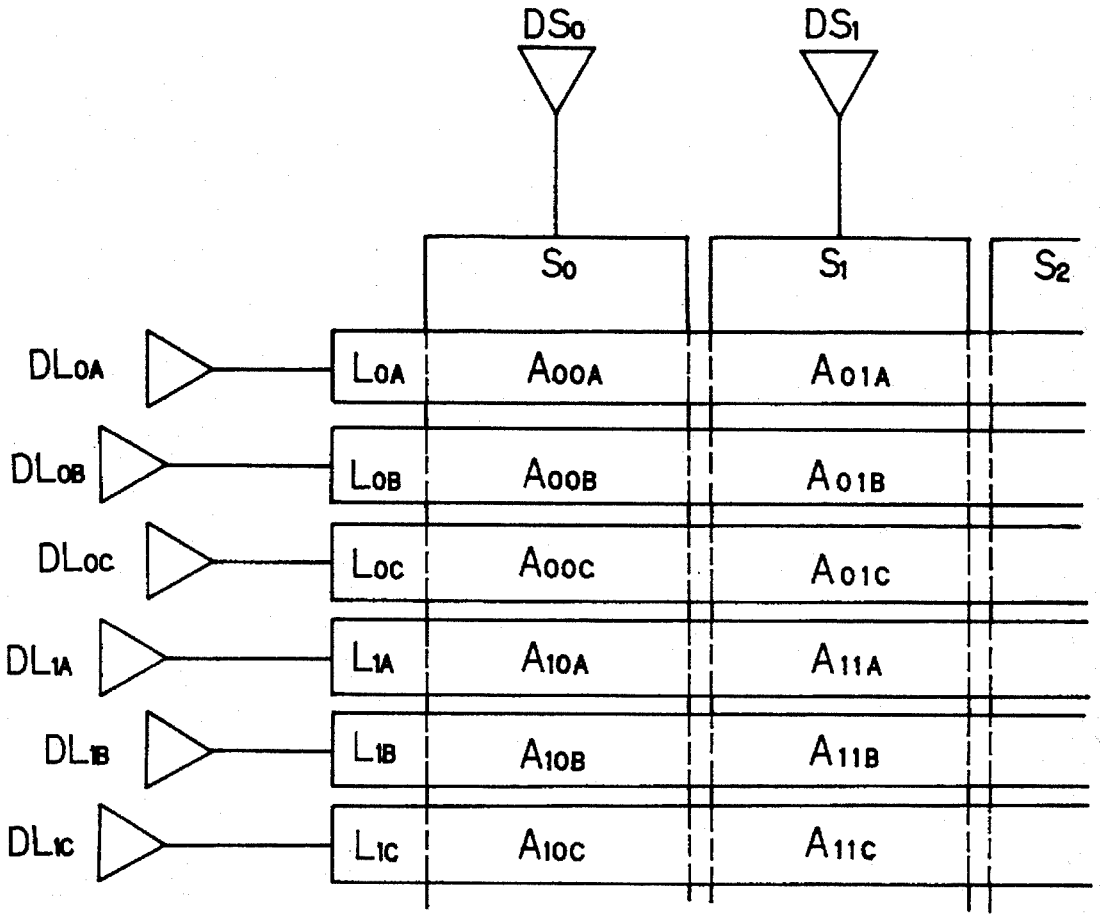
FIG. 5 is a plane view showing a configuration of pixel electrodes in an embodiment of the second and fourth feature of the present invention.

FIG. 5 is a plan view showing a configuration of pixel electrodes used in an embodiment in accordance with the second and fourth features of the present invention. Each pixel is constructed of three scan electrodes L, that is, scan electrodes $LA$, $L_{iB}$ and $L_{iC}$, and one signal electrode S. The scan electrodes L are connected to a scan-side driver circuit by way of output terminals $DL_{iA}$, $DL_{iB}$ and $DL_{iC}$ while the signal electrode S is connected to a signal-side driver circuit via an output terminal $DS_i$.

In this embodiment, a liquid crystal composition in which SCE-8, a product of MERCK CO., and a compound having the following constitutional formula [1] were blended in a ratio of 9:1 was used as the FLC 9, and PSI-A-2101, a product of CHISSO CORPORATION was used for the orientation films 7*a* and 7*b*.

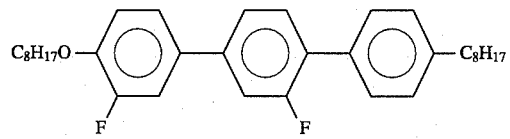

[1]

Here, this FLC 9 has negative anisotropy of dielectric constant and the device has two, or first and second stable conditions.

Using this liquid crystal display device, tonal display driving was effected in the following manner.

Initially, as to the scan electrodes, either of selected and non-selected voltages is applied to every set made of three scan electrodes constituting one pixel as a unit for scanning. Specifically, selected voltages are simultaneously applied to scan electrodes $L_{0A}$, $L_{0B}$ and $L_{0C}$ and non-selected voltages are supplied to the remaining scan lines so as to select the set made of the scan electrodes $L_{0A}$, $L_{0B}$ and $L_{0C}$. Subsequently, selected voltages are simultaneously applied to scan electrodes $L_{1A}$, $L_{1B}$ and $L_{1C}$ and non-selected voltages are supplied to the remaining scan lines. This operation is repeated successively.

Figure 6:
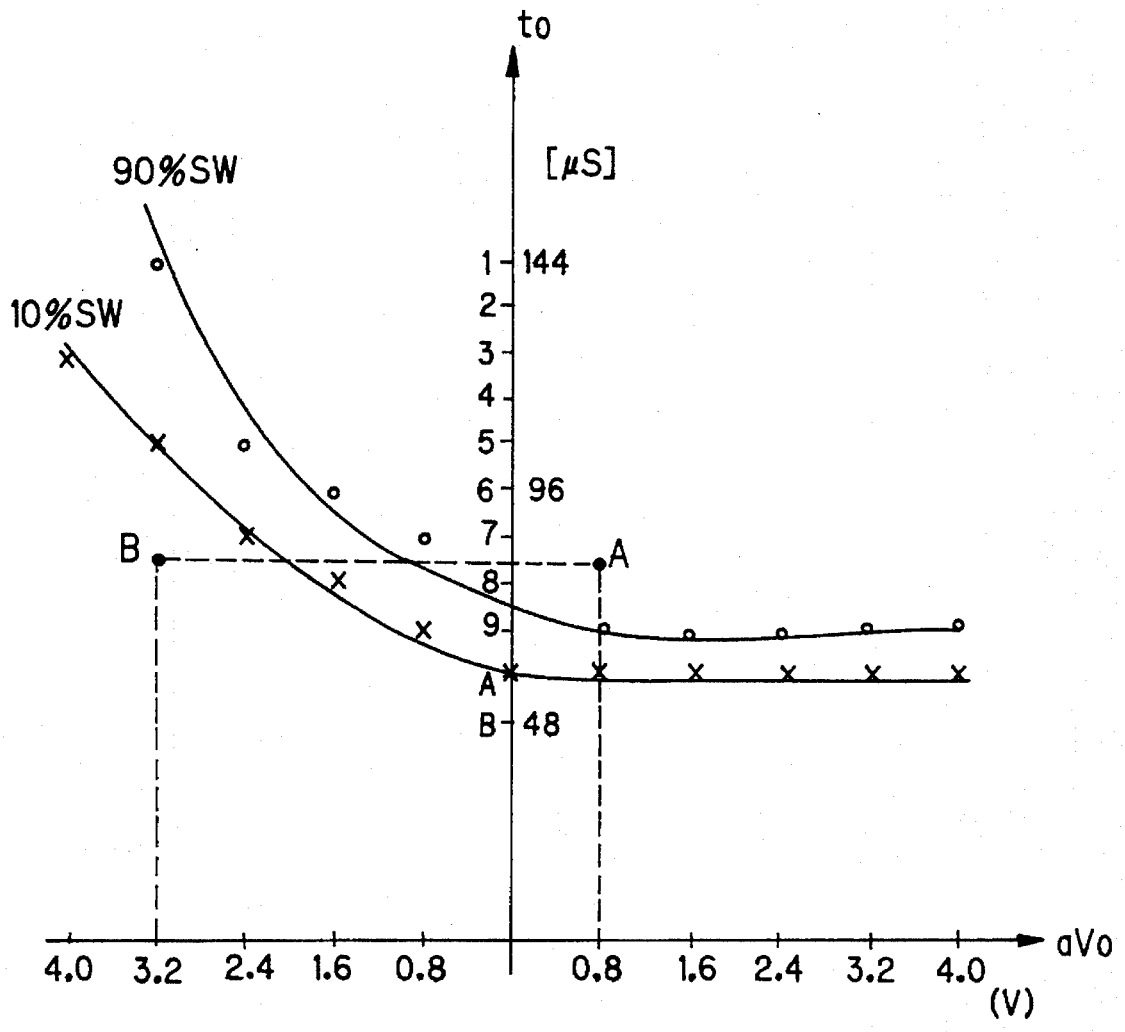
FIG. 6 is a chart showing relations of combined pulses of two consecutive pulses to switching pulse widths in an embodiment of the present invention.

FIG. 6 shows relations of combined pulses of two pulses having the same pulse width to switching pulse widths in the device of the embodiment. The lateral axis indicates a pulse voltage $aV_0$ for the front half of the combined pulse and the vertical axis indicates a pulse width $t_0$ for the rear half of the combined pulse. The voltage of the rear half of the pulse is assumed to be a differential value calculated by subtracting $aV_0$ from 40, specifically $(40-aV_0)$. In the chart, (o) indicates pulse widths of pulses causing 90% of the FLC molecules for the liquid crystal display device to be switched and (x) indicates pulse widths of pulses causing 10% of the FLC molecules to be switched. As understood from the chart, either variation in pulse width for 90% or 10% starts to become large from the area in which the combined pulse changes from the homopolarity to the heteropolarity.

Based on the data, both the front and rear halves of the combined pulse are set to have a pulse width of 80 μs and a voltage waveform at a point A in FIG. 6 is applied liquid crystal segments to be switched while a voltage waveform at a point B in FIG. 6 is applied to liquid crystal segments to be unswitched.

Figure 7:
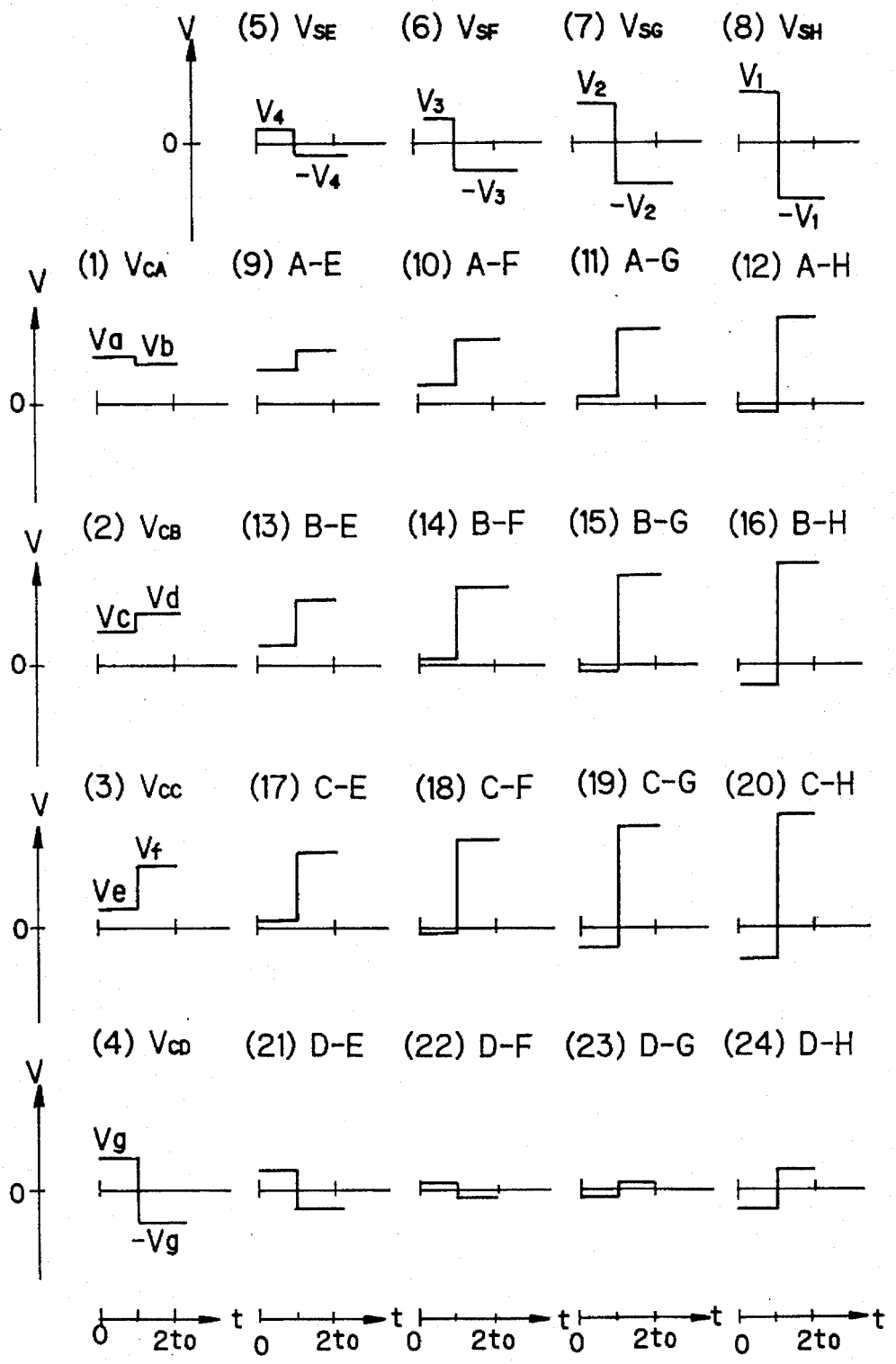
FIG. 7 is a chart showing voltage waveforms for preferable embodiments of the third and fourth features of the present invention.

FIG. 7 is a chart showing thus determined selected voltages, a non-selected voltage and signal voltages thus determined and waveforms of voltages to be applied to corresponding pixels. In the chart, each of voltage values was determined as follows:

$$a_0V_0 = V_e - V_4 = V_c - V_3 = V_a - V_2 = 0.8\ v$$
$$40 - a_0V_0 = V_f + V_4 = V_d + V_3 = V_b + V_2 = 39.2\ v$$
$$a_1V_0 = V_e - V_3 = V_c - V_2 = V_a - V_1 = -3.2\ v$$
$$40 - a_1V_0 = V_f + V_3 = V_d + V_2 = V_b + V_1 = 43.2\ v$$

-continued $$V_1 = V_2 + 4\ v = V_3 + 8\ v = V_4 + 12\ v$$
$$V_a = V_c + 4\ v = V_e + 8\ v$$
$$V_f = V_d + 4\ v = V_b + 8\ v$$
$$V_e = V_4 + 0.8\ v$$

Although the voltages $V_f$ and $V_1$ can be determined arbitrarily, $V_f$ and $V_1$ were determined as $V_f=V_1=25.6$ v in the embodiment. Accordingly, $V_{d=V2}=21.6$ v, $V_b=V_3=17.6$ v, $V_4=13.6$ v, $V_e=14.4$ v, $V_c=18.4$ v and $V_a=22.4$ v. In this case, it is possible to easily balance d.c. components through molecules inside pixels by setting up the pulse voltage of the front half to be $aV_0$ ($-1<a<1$) and the pulse voltage of the rear half to be $(1-a)V_0$ with both pulse widths equal to each other.

By using these voltage signals, the selected voltages $V_{CA}$, $V_{CB}$ and $V_{CC}$ different from one another were simultaneously applied to the three scan electrodes $L_{0A}$, $L_{OB}$ and $L_{0C}$ while the non-selected voltage $V_{SE}$ was applied to the remaining scan electrodes. When $V_{SF}$ was applied to the signal electrode $S_1$, all the three sub-pixels were rewritten into the first stable state; when $V_{SF}$ was applied, the sub-pixels $A_{01A}$ and $A_{01B}$ were rewritten into the first stable state; when $V_{SG}$ was applied, the sub-pixel $A_{01A}$ was rewritten into the first stable state; and when $V_{SH}$ was applied, no sub-pixel was rewritten, whereby four levels of tones could be displayed.

The reason why such driving can be done is that, when a ferroelectric liquid crystal having negative anisotropy of dielectric constant is used, the memory pulse width of the ferroelectric liquid crystal molecules behaves in response to a combined waveform of consecutive two pulses, as in the following manner: That is, if the combined pulse is composed of pulses of the same polarity, $E_{min}$ for the voltage of the rear half becomes larger and $\tau_{min}$ becomes smaller as the absolute value of the voltage of the front half becomes greater whereas, if the combined pulse is composed of pulses of opposite polarities, $E_{min}$ for the voltage of the rear half becomes smaller and $\tau_{min}$ becomes greater as the absolute value of the voltage of the front half becomes greater. Here, in the above statement, the polarity of the rear half voltage is so assumed as to drive the molecules to the other stable condition (the first stable condition). If the polarity for the rear half is opposite, the molecules cannot be changed in their stable condition regardless of whether the pulses constituting the combined pulse have the same polarity or opposite polarities.

Each of the voltages can be determined in the other way than what is done in the above embodiment. More specifically, these voltages can be determined so as to suffice the following relations:

$$V_a > V_c > V_e > 0$$
$$V_a + V_b = V_c + V_d = V_e + V_f$$
$$V_a - V_3 = V_c - V_4$$
$$V_c - V_3 = V_e - V_4$$
$$V_a - V_2 = V_c - V_3$$
$$V_c - V_2 = V_e - V_3$$
$$V_a - V_1 = V_c - V_2$$
$$V_c - V_1 = V_e - V_2$$
$$V_4 < V_3 < V_2 < V_1$$

In this case, the liquid crystal display device can be driven similarly, if the following conditions are satisfied with the pulse width $t_0=80$ μs:

$$a_0V_0 = V_e - V_4 = 0\ v$$
$$(1 - a_0)V_0 = V_f + V_4 = 40\ v - a_0V_0$$
$$a_1V_0 = V_e - V_3 \leqq -4\ v$$
$$(1 - a_1)V_0 = V_f + V_3 = 40\ v - a_1V_0$$

This presents an embodiment of the fourth feature of the present invention.

Meanwhile, applications of the voltages (9) through (20) shown in FIG. 7 may cause FLC molecules constituting pixels to change from the second stable condition to the first stable condition or to be retained in the latter condition but cannot cause the FLC molecules constituting pixels to change from the first stable condition to the second stable condition. To deal with this, the following two schemes were used.

The first scheme: Before the applications of the selected voltages $V_{CA}$, $V_{CB}$ and $V_{CC}$ (shown (1) to (3) in FIG. 7) to the scan electrodes $L_{iA}$, $L_{iB}$ and $L_{iC}$, respectively, there is time during which voltages $V_{CA}$, $V_{CB}$ and $V_{CC}$ (shown (1) to (3) in FIG. 7) are applied to the other scan electrodes $L_{KA}$, $L_{KB}$ and $L_{KC}$ ($k\neq i$). During the time, a voltage $-V_h$ ($-V_h<V_4$) is applied to the scan electrodes $L_{iA}$, $L_{iB}$ and $L_{iC}$ and then, a voltage $-V_r$ ($-V, <V_1$) is applied to those electrodes. In this case, even if any voltage shown in (5) to (8) in FIG. 7 is being applied to any of the signal electrodes Ss, the voltages to be applied to the scan electrodes $L_{1A}$, $L_{iB}$ and $L_{iC}$ become to have homopolar waveforms as shown in (26) to (29) in FIG. 8, whereby the state of the FLC molecules constituting those pixels on the scan electrodes $L_{iA}$, $L_{iB}$ and $L_{iC}$ is caused to change into the other stable condition.

As d.c. component of the voltages applied to FLC molecules must be canceled, the following condition is preferably added:

$$V_h+V_r=V_a+V_b=V_c+V_d=V_e+V_f$$

In this embodiment, $V_h$ and $V_r$ were set as $-V_h=-10$ v and $-V_r=30$ v. Further, when the remaining scan electrodes $L_1$ ($l\neq k$, $l\neq i$) are impressed with a combined waveform composed of a pulsing voltage $V_g$v=(defined as $V_2+V_3)/2$) having a pulse width of to and a subsequent pulsing voltage $-V_g$ having a pulse width of $t_0$, the FLC molecules constituting the corresponding pixel $A_{lJ}$ on the scan electrodes will not change in its stable condition. In this embodiment, $V_g$ was set as $V_g=19.6$ v.

Figure 9:
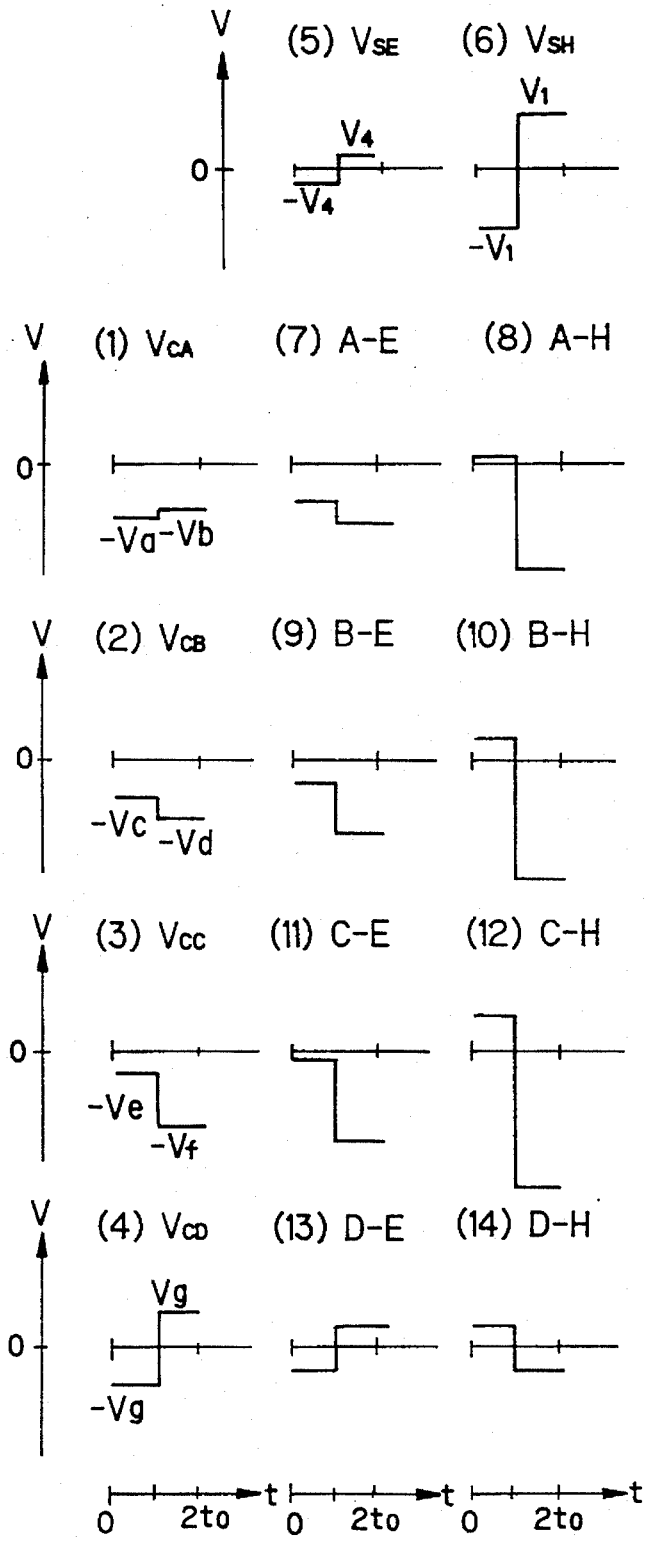
FIG. 9 is a chart showing voltage waveforms to be solely applied to in the embodiments of the third and fourth features of the present invention.

The second scheme includes the steps of taking time during which any of the selected voltages $V_{CA}$, $V_{CB}$ and $V_{CC}$ (shown (1) to (3) in FIG. 7) is not applied to any of the scan electrodes $L_{KA}$, $L_{KB}$ and $L_{KC}$, and effecting applications of voltages during the time in such a manner that a combined waveform composed of a pulsing voltage $-V_a$ having a pulse width of $t_0$ and a subsequent pulsing voltage $-V_b$ having a pulse width of to (shown in (1) in FIG. 9) is applied to the scan electrode $L_{iA}$; a combined waveform composed of a pulsing voltage $-V_c$ having a pulse width of $t_0$ and a subsequent pulsing voltage $-V_d$ having a pulse width of $t_0$ (shown in (2) in FIG. 7) is applied to the scan electrode $L_{iB}$; and a combined waveform composed of a pulsing voltage $-V_e$ having a pulse width of $t_0$ and a subsequent pulsing voltage $-V_f$ having a pulse width of $t_0$ (shown in (3) in FIG. 7) is applied to the scan electrode $L_{iC}$.

In this case, the signal electrode $S_J$ for allowing the FLC molecules constituting the pixel $A_{ij}$ to change from its current stable condition into the other stable condition is impressed with a combined waveform composed of a pulsing voltage $-V_4$ having a pulse width of $t_0$ and a subsequent pulsing voltage $V_4$ having a pulse width of $t_0$ (shown in (5) in FIG. 9). As a result, differential potentials (shown in (7), (9) and (11) in FIG. 9) between the signal electrode and the corresponding scan electrodes are applied to respective sub-pixels $A_{ijA}$, $A_{ijB}$ and $A_{ijC}$, whereby the FLC molecules constituting the pixel $A_{ij}$ are changed from the current stable condition into the other stable condition. The signal electrode $S_J$ for retaining the current stable condition of the FLC molecules constituting the pixel $A_{ij}$ is impressed with a combined waveform (shown in (6) in FIG. 9) composed of a pulsing voltage $-V_1$ having a pulse width of $t_0$ and a subsequent pulsing voltage $V_1$ having a pulse width of $t_0$, and applying differential potentials (shown in (8), (10) and (12) in FIG. 9) between the signal electrode and the corresponding scan electrodes to respective sub-pixels $A_{ijA}$, $A_{ijB}$ and $A_{ijC}$, whereby retain the current stable condition of the FLC molecules constituting the pixel $A_{ij}$. Unselected scan electrodes $L_K$ are impressed with a combined waveform (shown in (4) in FIG. 9) composed of a pulsing voltage $-V_g$ having a pulse width of $t_0$ and a subsequent pulsing voltage $V_g$ having a pulse width of $t_0$, so that the FLC molecules constituting the pixels $A_{KJ}$ on the scan electrode $L_K$ to which the non-selected voltage $V_{CD}$ is applied are retained in the current stable condition regardless of the voltage applied to the signal electrode $S_J$.

In this embodiment, although the voltage to be applied to the scan electrode $L_{iB}$ shown in FIG. 7(2) or the selected voltage $V_{CB}$, is directly supplied from the scan-side driver circuit, it is also possible to indirectly supply it to the scan-side driver $L_{iB}$ by capacitively joining the scan electrode $L_m$ with the scan electrodes $L_{iA}$ and $L_{iC}$ located on both sides thereof and directly applying voltages from the scan-side driver circuit to the scan electrodes $L_{iA}$ and $L_{iC}$ since the selected voltage $V_{CB}$ shown in FIG. 7(2) is an intermediate voltage between the selected voltage $V_{CA}$ shown in FIG. 7(1) and the selected voltage $V_{CC}$ shown in FIG. 7(3). In this case, since the combined impedance becomes small as the combined capacity becomes large, the waveform of the voltage to be applied to the scan electrode $L_{iB}$ will not be distorted. As a result it is possible to obtain gradation display which is uniform throughout the panel surface.

In a case where a ferroelectric liquid crystal presenting positive anisotropy of dielectric constant is used, the memory pulse width monotonously decreases with the applied voltage to the pixel becomes large. It is also possible to effect gradation display using such a liquid crystal by applying selected voltages simultaneously to a plurality of scan electrodes as done above in the present invention.

Figure 10:
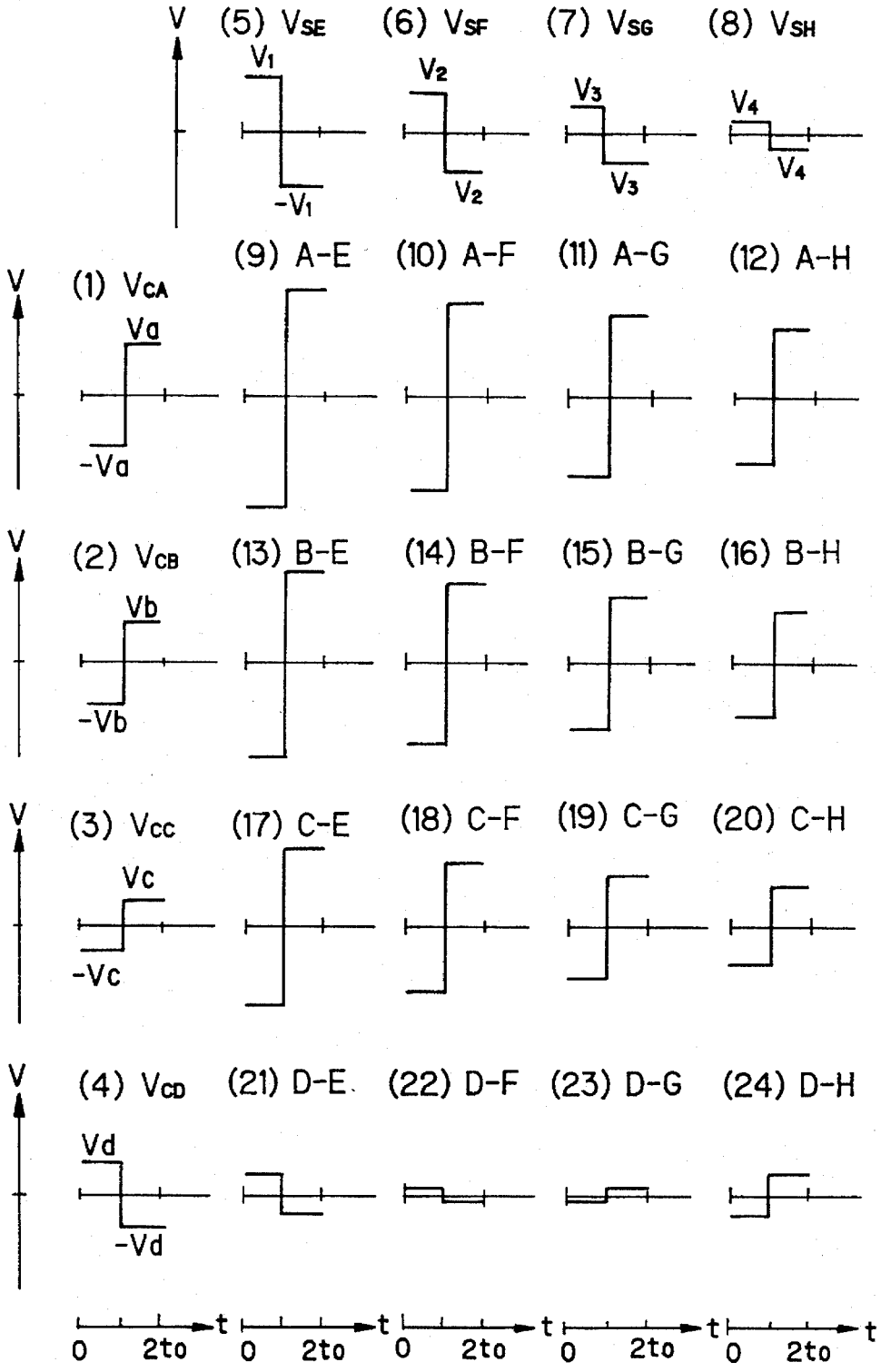
FIG. 10 is a chart showing another example of voltage waveforms in accordance with the second feature of the present invention.

In this case, voltage waveforms shown in FIG. 10 are used in place of the voltage waveforms shown in FIG. 7 for the above embodiment. Voltages in FIG. 10 suffice the following relations:

$$V_a + V_1 > V_a + V_2 > V_a + V_3 > V_a + V_4$$
$$V_c + V_1 = V_b + V_2 = V_a + V_3$$
$$V_c + V_2 = V_b + V_3 = V_a + V_4$$

Further, in this configuration, the following conditions are required. That is, it is necessary that the stable state of the FLC molecules constituting pixels can be changed from one stable condition to the other stable condition when a combined waveform composed of a pulsing voltage $(-V_C-V_1)$ having a pulse width of to and a subsequent pulsing voltage $(V_c+V_1)$ having a pulse width of $t_0$ is applied to the pixel and at the same time, that the stable state of the FLC molecules constituting pixels should not be changed from one stable condition to the other stable condition when a combined waveform composed of a pulsing voltage $(-V_c-V_2)$ having a pulse width of to and a subsequent pulsing voltage $(V_c+V_2)$ having a pulse width of $t_0$ is applied to the pixel. In such the liquid crystal, however, the differential potential between the thus set up voltages $(V_c+V_1)$ and $(V_c+V_2)$ is great as compared to the differential potential between the voltages $(V_e-V_4)$ and $(V_e-V_3)$ in the previous embodiment. Accordingly, this configuration requires a wide voltage range for driving and if the voltage range is made narrow, the frequency of malfunctions increases. Yet, the configuration can be feasible in spite of such difficulties and represents an embodiment of the second feature of the present invention.

Although only one signal electrode is used for forming a single pixel in either of the above embodiments, a plurality of signal electrodes may be used. Besides, the pixel may be formed with two or more than three scan electrodes.

Figure 14A:
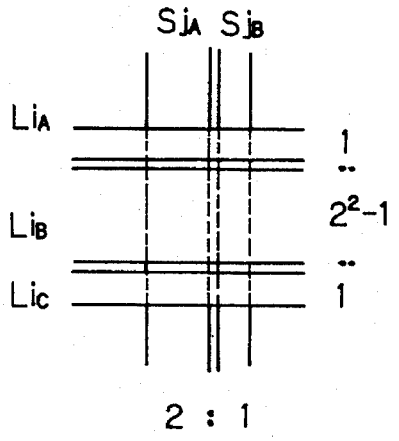
FIG. 14A is a plan view showing a first variation of a pixel electrode structure of an embodiment of the first feature of the present invention.

FIG. 14A shows an embodiment in which two signal electrodes $S_{jA}$ and $S_{jB}$ are provided in a line width ratio of 2:1 while three scan electrodes $L_{iA}$, $L_{iB}$ and $L_{iC}$ are provided in a line width ratio of $1:2^2-1:1$. Further variational embodiments with various electrode structures are shown in FIGS. 14A through 14D in accordance with the first feature of the present invention.

Figure 11:
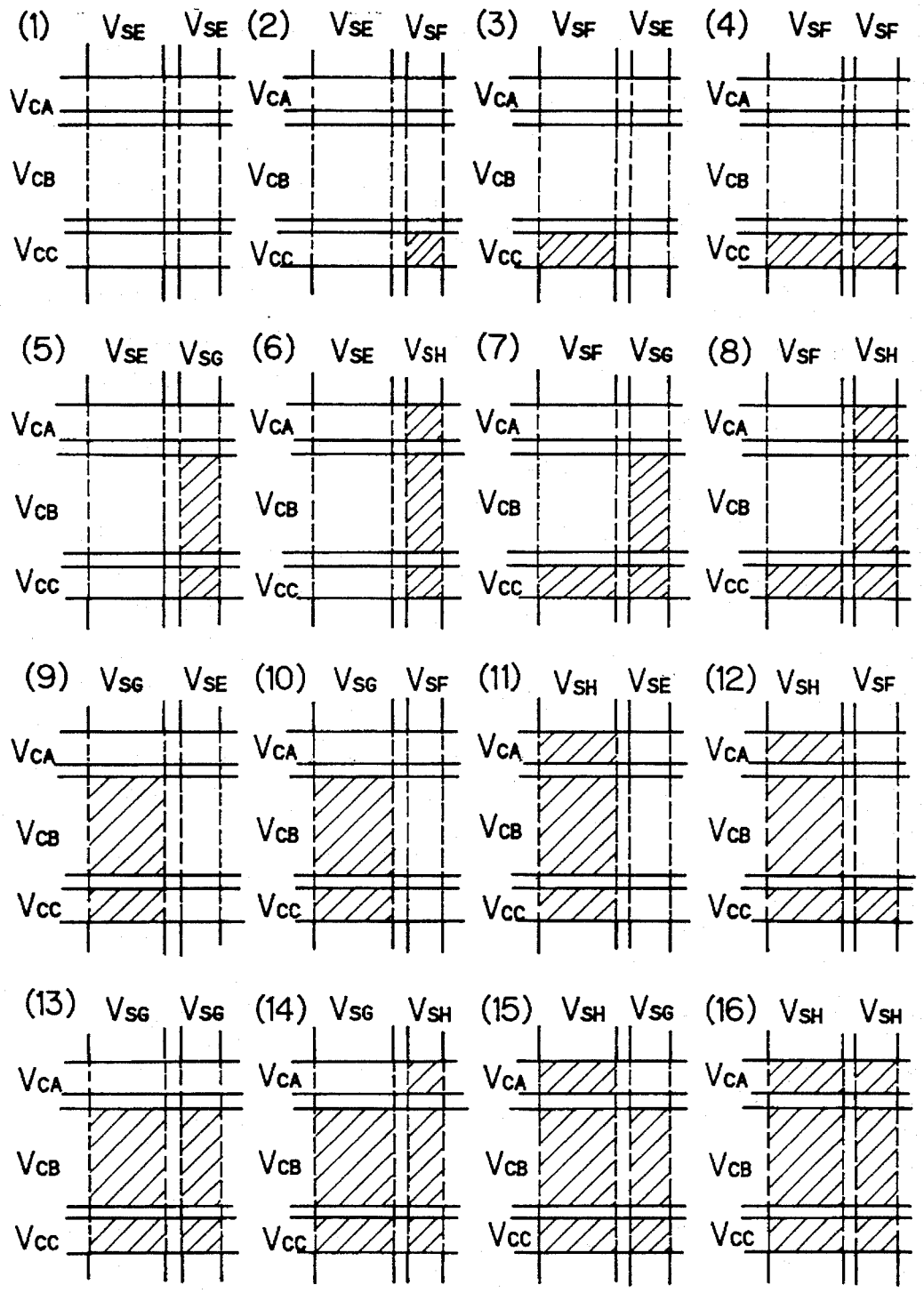
FIG. 11 is a chart for illustrating sixteen levels of gradational display states in an embodiment of the first feature of the present invention.

As is understood from FIG. 11, three sub-pixels on the same signal electrode are reversed or turned on necessarily in the order of the scan electrodes $L_{iA}\rightarrow L_{iB}\rightarrow L_{iC}$ from the dark tone state to the light tone state, so that it is possible to display four levels of tones, specifically, in a ratio of $0:1:2^2:2^2+1$ for every signal electrode.

In this case, all the FLC molecules constituting the sub-pixels of the pixel $A_t$ are preset in one stable condition, then the selected voltages $V_{CA}$, $V_{CB}$ and $V_{CC}$ shown in (1) to (3) in FIG. 7 are applied to the three scan electrodes $L_{iA}$, $L_{iB}$ and $L_{iC}$ forming the pixel $A_{ij}$. At that time, when a voltage $V_{SE}$, $V_{SF}$, $V_{SG}$ or $V_{SH}$ shown in (5) through (8) in FIG. 7 is applied to the signal electrode $S_{jA}$, it is possible to represent four levels of tones, that is, 0, 1, 4 and 5 using pixels $A_{ijAB}$, $A_{ijBB}$ and $A_{ijCB}$ on the signal electrode $S_{ij}$. If a voltage $V_{SE}$, $V_{SF}$, $V_{SG}$ or $V_{SH}$ shown in (5) to (8) in FIG. 7 is applied to the signal electrode $S_{jB}$, it is possible to represent four levels of tones, that is, 0, 2, 8 and 10 by using pixels $A_{ijAA}$, $A_{ijBA}$ and $A_{ijCA}$ on the signal electrode $S_{JA}$ as if sub-pixels divided in an area ratio of 2:8 were used.

By combining the above-described two types of four-level tone display schemes, it is possible to represent sixteen levels of tones, using the pixels $A_{ijAB}$, $A_{ijBB}$ and $A_{ijCB}$ on the signal electrode $S_{jB}$ and the pixels $A_{ijAA}$, $A_{ijBA}$and $A_{ijCA}$ on the signal electrode $S_{jA}$.

Figure 14B:
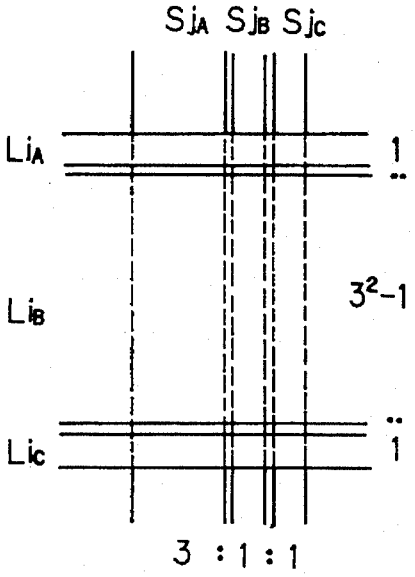
FIG. 14B is a plan view showing a second variation of a pixel electrode structure of the embodiment of the first feature of the present invention.

FIG. 14B shows a similar embodiment in which three signal electrodes $S_{jA}$, $S_{jB}$ and $S_{jC}$ care provided in a line width ratio of 3:1:1 while three scan electrodes $L_{iA}$, $L_{iB}$ and $L_{iC}$ are provided in a line width ratio of $1:3^2-1:1$.

Similarly to the case of FIG. 11, three sub-pixels on the same signal electrode are reversed or turned on necessarily in the order of the scan electrodes $L_{iA}\rightarrow L_{iB}\rightarrow L_{iC}$ from the dark tone state to the light tone state, so that it is possible to display four levels of tones, specifically in a ratio of $0:1:3^2:3^2+1$ for every signal electrode.

Figure 14C:
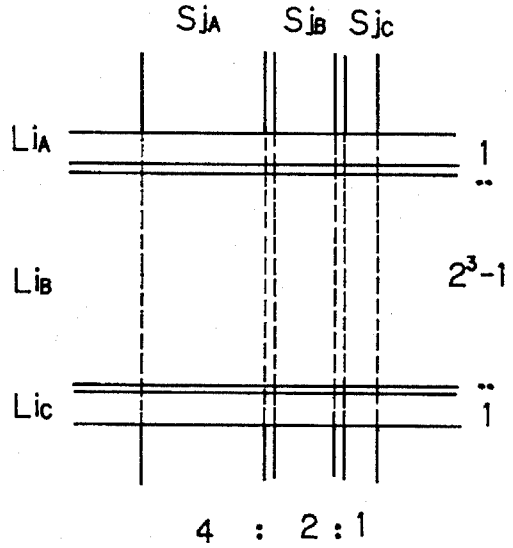
FIG. 14C is a plan view showing a third variation of a pixel electrode structure of the embodiment of the first feature of the present invention.

FIG. 14C shows an alternative embodiment in which three signal electrodes $S_{jA}$, $S_{jB}$ and $S_{iC}$ are provided in a line width ratio of 4:2:1 while three scan electrodes $L_{iA}$, $L_{iB}$ and $L_{iC}$ are provided in a line width ratio of $1:2^2-1:1$.

Similarly to the case of FIG. 11, three sub-pixels on the same signal electrode are reversed or turned on necessarily in the order of the scan electrodes $L_{iA}\rightarrow L_{iB}\rightarrow L_{iC}$ from the dark tone state to the light tone state, so that it is possible to display four levels of tones, specifically, in a ratio of $0:1:2^3:2^3+1$ for every signal electrode.

Figure 14D:
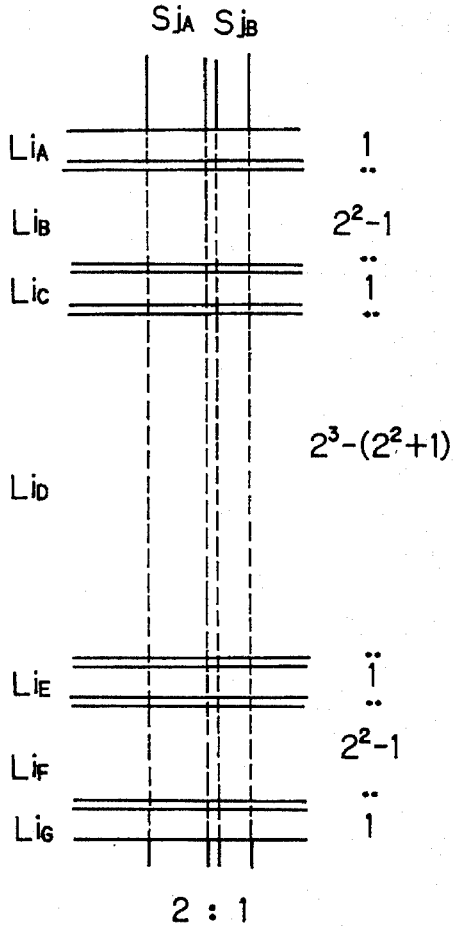
FIG. 14D is a plan view showing a fourth variation of a pixel electrode structure of the embodiment of the first feature of the present invention.

Although it could be conceived from the above description of the embodiments that the present invention is limited to the case in which one pixel is constructed with three scan electrodes, an electrode structure shown in FIG. 14D can be an embodiment of the first feature of the present invention, in which two signal electrodes $S_{jA}$ and $S_{jB}$ are provided in a line width ratio of 2:1 while seven scan electrodes $L_{iA}$, $L_{iB}$, $L_{iC}$, $L_{iD}$, $L_{iE}$, $L_{iF}$ and $L_{iG}$ are provided in a line width ratio of $1:2^2-1:1:2^3-(2^2+1):1:2^2-1:1$.

Thus, the structure of electrodes in accordance with the first feature of the present invention is characterized in that three scan electrodes $L_{iA}$, $L_{iB}$ and $L_{iC}$ of a multiple number of scan electrodes constituting a single pixel are provided in a line width ratio of 1: $M^P-1:1$ (both M and P are integers of 2 or more).

The case where the waveforms shown in FIG. 7 are applied to the thus divided scan electrodes presents an embodiment of the third feature of the present invention.

Figure 12:
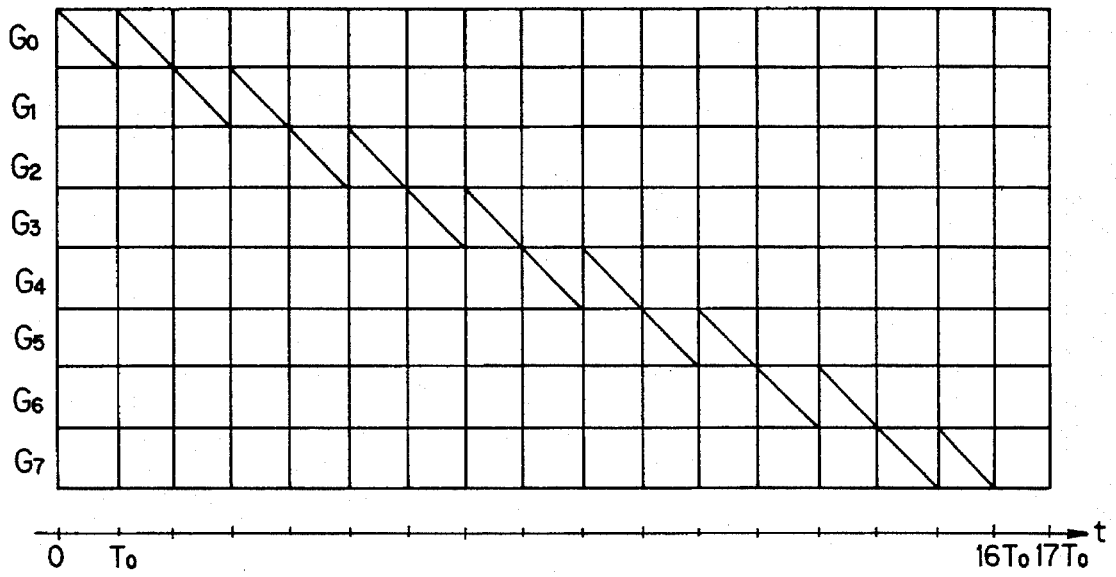
FIG. 12 is a chart for illustrating scan timing for gradational display based on a time-dividing method in a fifth embodiment.

In a case where a liquid crystal display device used is constructed so as to be able to display sixteen levels of tones by the method shown in FIG. 11, it is possible to apply the method of Japanese Patent Application Laid-Open Sho 64 No.61,180 to the liquid crystal display device capable of displaying M levels of tones and therefore to display $16^{16}$ levels of tones (0-th to $(16^6-1)$-th levels), by dividing all the scan electrodes for the liquid crystal display device into $(1+M)/2=17/2\geqq 8$ groups as shown in FIG. 12, scanning a certain group of scan electrodes in a first term (t=0 to $T_0$), scanning the same group of scan electrodes in a next term (t=$T_0$ to $2T_0$), scanning the remaining groups of scan electrodes repeatedly in a similar manner, and scanning the first group of scan electrodes during a term from $17T_0$ to $18T_0$).

More specifically, as shown in FIG. 12, all the scan electrodes for an FLC panel are divided into eight blocks $G_0$ to $G_7$. During the term from 0 to $T_0$, the block $G_0$ is scanned (this is represented in FIG. 12 by an oblique solid line drawn in a frame of the block $G_0$ for the term from 0 to $T_0$). The block $G_0$ is scanned again during the term from $T_0$ to $2T_0$. The block $G_0$ is scanned during the term from $2T_0$ to $3T_0$ and scanned again during the term from $3T_0$ to $4T_0$, and so on until the block $G_7$ is scanned during the term from $14T_0 15T_0$ and scanned again during the term from $15T_0$ to $16T_0$. No block is scanned during the term from $16T_0$ to $17T_0$. Then, the block $G_0$ is scanned during the term from $18T_0$ to $19T_0$, thus second and the following rounds are repeated in the same manner. By this operation, a ratio of a time interval from a first scan to a second scan to another time interval from the second scan to a next first scan can be set up to be 1:16 for every block, thus making it possible to turn on the pixel for time intervals of 1:16.

The amount of transmitted light is represented by (area of a pixel)×(turn-on time). Therefore, if, in a liquid crystal device in which sixteen levels (0 to 15) of turn-on area can be set up for each pixel as shown in FIG. 11, the pixels are scanned by the time-division scanning as shown in FIG. 12, it is possible to independently set up turn-on areas during the time interval of $T_0$ from a first scan to a second scan and turn-on areas during the time interval of $16T_0$ from the second scan to a next first scan among all the sub-pixels constituting the pixel. Therefore, it is possible to display 256 levels of tones (0th to 255-th levels) by the (area)×(turn-on time). This presents a fifth embodiment.

By the way, in general, sequentially scanning signals are used for information signals outputted on a display of personal computers and the like while interlaced scanning signals are used for information signals outputted on a display of television apparatuses and the like. If interlaced scanning signals are supplied as it is to a display device having memory-retaining performances such as an FLCD etc., data for odd-number fields are to be displayed in even-number fields, resulting in generation of after-images and the like when motion pictures are displayed.

To deal with this, a method is proposed for TFT display devices etc., in which data for even-number fields to be applied in a scan electrode $L_{2n}$ is written in both scan electrodes $L_{2n}$ and $L_{2n+1}$ and data for odd-number fields to be applied to a scan electrode $L_{2n+1}$ is written in both scan electrodes $L_{2n+1}$ and $L_{2n+2}$. In the embodiment of the present invention, it is possible to effect similar scanning, but it is also possible to effect another method, as shown in FIG. 13, in which data for even-number fields is written in a scan electrode $L_{2n}$ as data in a scan electrode $L_{2n+1}$ being erased (this is represented in FIG. 12 by an oblique solid line drawn in a frame of the block $G_0$ for the term from $_0$ to $T_0$.) and data for odd-number fields is written in the scan electrode $L_{2n+1}$ as data in the scan electrode $L_{2n+1}$ being erased.

That is, an FLC panel can be driven in a manner as follows: All the odd-numbered scan electrodes for the FLC panel are divided into eight blocks $G_0$ to $G_7$ and all the even-numbered scan electrodes for the FLC panel are divided into eight blocks $G_8$ to $G_F$. During the term from 0 to $T_0$, the block $G_0$ is scanned as the block $G_8$ being erased (this is represented in FIG. 13 by an oblique broken line drawn in a frame of the block $G_8$ for the term from $_0$ to $T_0$). The block $G_0$ is scanned again during the term from $T_0$ to $2T_0$. The block $G_1$ is scanned as the block $G_9$ being erased during the term from $2T_0$ to $3T_0$, and the block $G_1$ is scanned again during the term from $3T_0$ to $4T_0$, and so on until the block $G_7$ is scanned as the block $G_F$ being erased during the term from $14T_0$ to $15T_0$ and the block $G_7$ is scanned again during the term from $15T_0$ to $16T_0$. No block is scanned during the term from $16T_0$ to $17T_0$. Then, the block $G_8$ is scanned as the block $G_0$ being erased during the term from $17T_0$ to $18T_0$ and the block $G_8$ is scanned again during the term from $18T_0$ to $19T_0$, and so on until the block $G_F$ is scanned as the block $G_7$ being erased during the term from $31T_0$ to $32T_0$ and the block $G_F$ is scanned again during the term from $32T_0$ to $33T_0$. No block is scanned during the term from $33T_0$ to $34T_0$. Thereafter the block $G_0$ is scanned as the block $G_8$ being erased during the term from $34T_0$ to $35T_0$ for a next round and so on.

Figure 8:
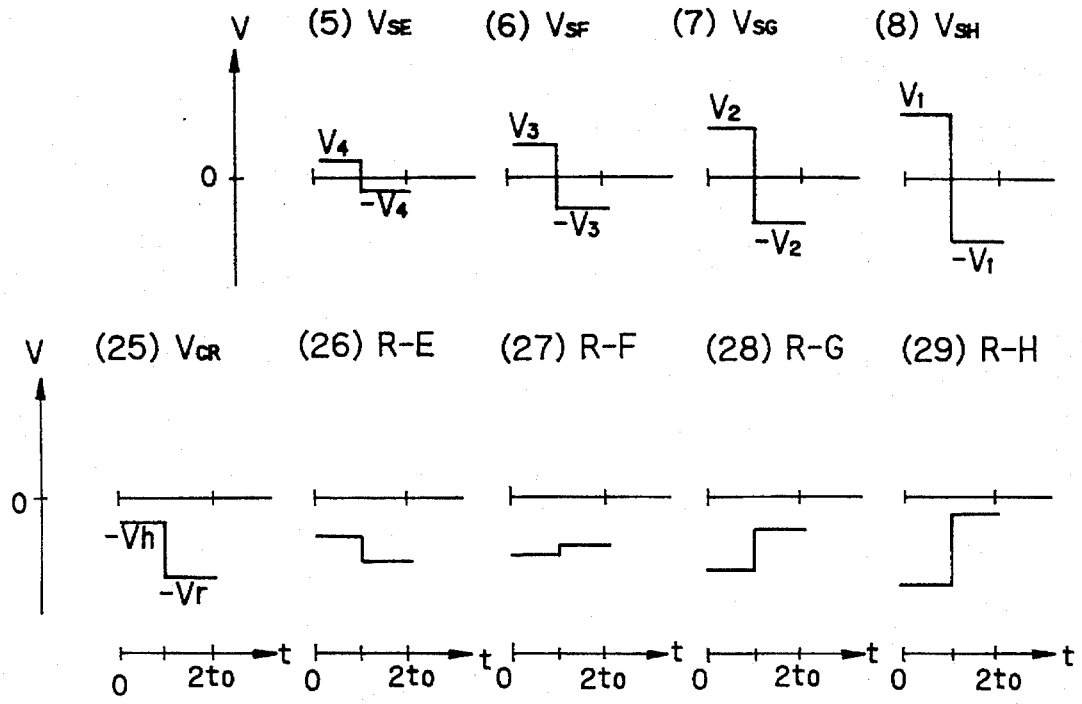
FIG. 8 is a chart showing voltage waveforms applied before application of selected voltages for the embodiments of the third and fourth features of the present invention.

In this case, when combinations of voltage waveforms shown in FIG. 7 and FIG. 8 are used for writing pixel data and for erasing pixel data, respectively, no extra time is required for scanning. When combinations of voltage waveforms in FIG. 8 are used to cause the FLC molecules constituting pixels to change into one of the stable states, it is preferable that the pixels are turned into a dark tone display state.

Figure 13:
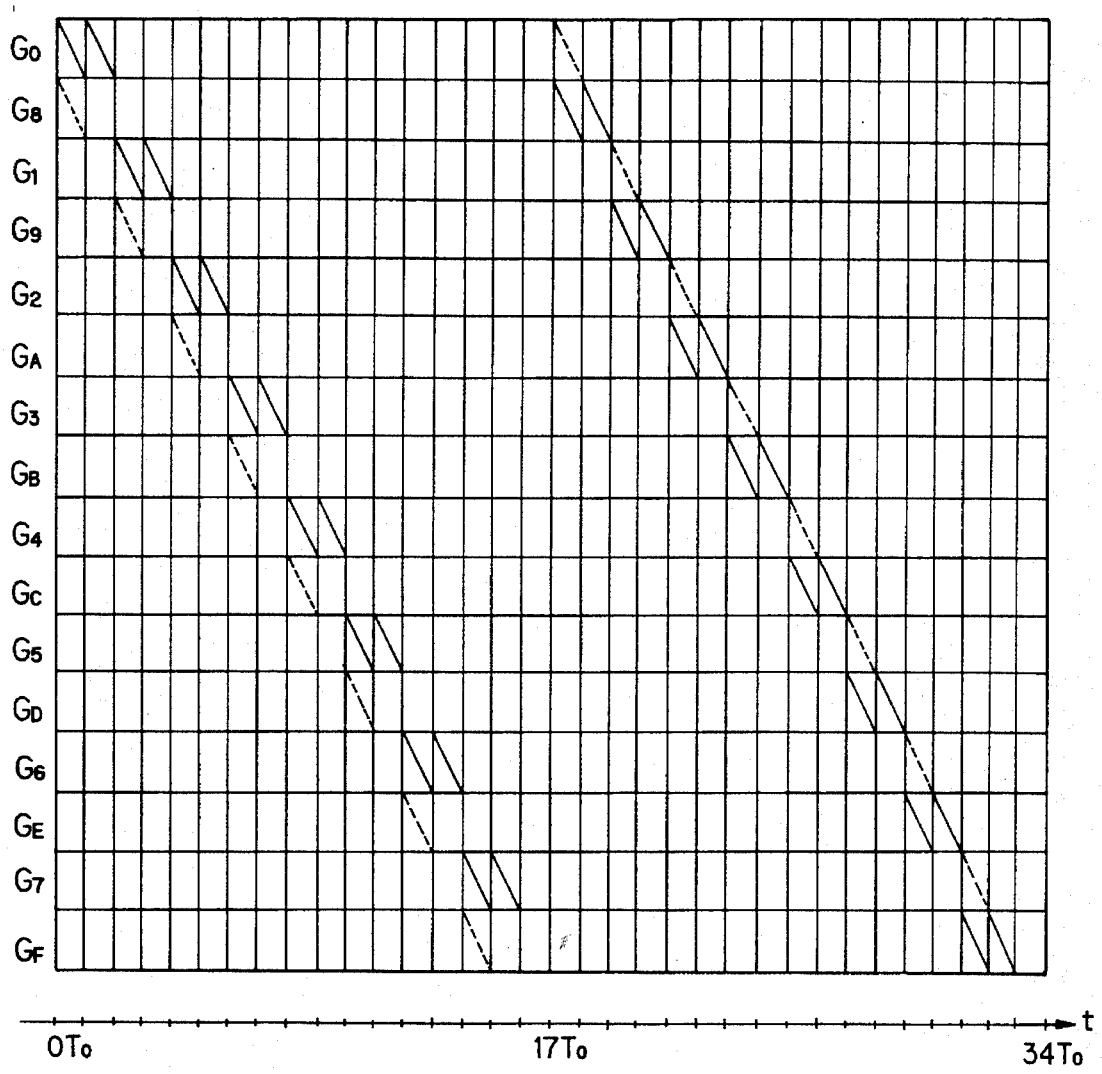
FIG. 13 is a chart for illustrating scan timing for gradational display based on another time-dividing method in the fifth embodiment.

In the case of FIG. 13, it might be conceived as if all the scan electrodes for the liquid crystal display device were divided into sixteen groups, but it can be understood that a device which originally allows such an operation that "the blocks $G_0$ and $G_8$ are scanned during the term from 0 to $2T_0$ and the blocks $G_0$ and $G_8$ are scanned during the term from $2T_0$ to $4T_0$ and so on" is merely used in synchronization with the interlaced scanning to effect the operation in which "the block $G_o$ is scanned during the term from 0 to $T_0$ and the block $G_8$ is scanned during the term from $17T_0$ to $18T_0$, the block $G_0$ is scanned during the term from $T_0$ to $2T_0$ and the block $G_8$ is scanned during the term from $18T_0$ to $19T_0$ and so on."

Thus, in accordance with the first feature of the present invention, pixel-division as shown in FIG. 11 can be done without causing neighboring pixels to form unintentional pairing. In accordance with the second feature of the present invention, different voltages can be applied to different sub-pixels each formed of multiple number of scan electrodes and a single signal electrode, whereby it is possible to effect independent switching of ferroelectric liquid crystal constituting each of the sub-pixels and therefore to realize gradational display.

Particularly, in accordance with a preferred embodiment of the present invention, when a ferroelectric liquid crystal display device in which each pixel is divided by providing a multiple number of scan electrodes for the pixel, is used to effect gradational display by simultaneously selecting plural scan lines, it is possible for the device to drive using a narrow driving voltage range and therefore it is possible to improve controllability of gradational display.

Further, it is possible to maintain d.c. balance of the liquid crystal molecules in a good condition.

Besides, as shown in the fifth embodiment, it is possible to display $M^M$ levels of tones (0-th to $(M^M-1)$-th levels) by using the liquid crystal display device which is provided by the first to fourth features of the present invention so as to be capable of displaying M levels of tones.

What is claimed is:

1. A ferroelectric liquid crystal display device comprising:

a plurality of scan electrodes disposed parallel to each other wherein each scan electrode is provided with a plurality of sub-scan electrodes;

a plurality of signal electrodes disposed parallel to each other and perpendicular to said scan electrodes; and a ferroelectric liquid crystal disposed at crossing points of said scan electrodes and said signal electrodes to form pixels, wherein each of said pixels is provided with said plurality of sub-scan electrodes so as to form a multiple number of sub-pixels constituting the pixel, characterized in that said plurality of sub-scan electrodes are provided for a single pixel in a line width ratio of 1: $N^P$–1:1 (N and P are integers of 2 or more).

2. A ferroelectric liquid crystal display device comprising:

a plurality of scan electrodes disposed parallel to each other wherein each scan electrode is provided with a plurality of sub-scan electrodes;

a plurality of signal electrodes disposed parallel to each other and perpendicular to said scan electrodes; and a ferroelectric liquid crystal disposed at crossing points of said scan electrodes and said signal electrodes to form pixels, wherein each of said pixels is provided with said plurality of sub-scan electrodes so as to form a multiple number of sub-pixels constituting the pixel, characterized in that different voltages are applied simultaneously and independently from one another to said plurality of sub-scan electrodes for a single pixel.

3. A driving method of effecting gradational display for a ferroelectric liquid crystal display device comprising:

a plurality of scan electrodes disposed parallel to each other wherein each scan electrode is provided with a plurality of sub-scan electrodes;

a plurality of signal electrodes disposed parallel to each other and perpendicular to said scan electrodes; and a ferroelectric liquid crystal disposed at crossing points of said scan electrodes and said signal electrodes to form pixels, wherein each of said pixels is provided with said plurality of sub-scan electrodes so as to form a multiple number of sub-pixels constituting the pixel and said plurality of sub-scan electrodes are provided for a single pixel in a line width ratio of 1: $N^P$–1:1 (N and P are integers of 2 or more), said method comprising the steps of:

using said ferroelectric liquid crystal having negative anisotropy of dielectric constant;

simultaneously applying different voltage waveforms from each other to separate, plural sub-scan electrodes constituting a single pixel; and applying voltages to signal electrodes corresponding to said scan electrodes in such a manner that, if the display state of a sub-pixel to be impressed with a voltage is to be changed into an alternate state, the voltage to be applied to the sub-pixel takes a waveform of consecutive two homopolar pulses, and if the display state of the sub-pixel is to be unchanged, the voltage to be applied to the sub-pixel takes a waveform of consecutive two heteropolar pulses.

4. A driving method of effecting gradational display for a ferroelectric liquid crystal display device comprising:

a plurality of scan electrodes disposed parallel to each other wherein each scan electrode is provided with a plurality of sub-scan electrodes;

a plurality of signal electrodes disposed parallel to each other and perpendicular to said scan electrodes; and a ferroelectric liquid crystal disposed at crossing points of said scan electrodes and said signal electrodes to form pixels, wherein each of said pixels is provided with said plurality of sub-scan electrodes so as to form a multiple number of sub-pixels constituting the pixel and different voltages are applied simultaneously to said plurality of sub-scan electrodes for a single pixel, said method comprising the steps of:

using said ferroelectric liquid crystal having negative anisotropy of dielectric constant;

simultaneously applying different voltage waveforms independently from each other to plural sub-scan electrodes constituting a single pixel; and applying voltages to signal electrodes corresponding to said scan electrodes in such a manner that, if the display state of a sub-pixel to be impressed with a voltage is to be changed into an alternate state, the voltage to be applied to the sub-pixel takes a waveform of consecutive two homopolar pulses, and if the display state of the sub-pixel is to be unchanged, the voltage to be applied to the sub-pixel takes a waveform of consecutive two heteropolar pulses.

5. A driving method of effecting gradational display for a ferroelectric liquid crystal display device according to claim 3 wherein the integral of voltage with respect to time for an applied waveform to any sub-pixel is made equal for all the voltage waveforms.

6. A driving method of effecting gradational display for a ferroelectric liquid crystal display device according to claim 4 wherein the integral of voltage with respect to time for an applied waveform to any sub-pixel is made equal for all the voltage waveforms.

7. A ferroelectric liquid crystal display device according to claim 1 wherein said ferroelectric liquid crystal display device used is capable of displaying M levels of tones, has all the scan electrodes therein divided into groups of scan electrodes in a number of (1+M)/2 or less, and is constructed such that a certain group of scan electrodes is scanned and subsequently the same group of scan electrodes is scanned, thereafter the remaining groups of scan electrodes are scanned successively.

8. A ferroelectric liquid crystal display device according to claim 2 wherein said ferroelecteric liquid crystal display device used is capable of displaying M levels of tones, has all the scan electrodes therein divided into groups of scan electrodes in a number of (1+M)/2 or less, and is constructed such that a certain group of scan electrodes is scanned and subsequently the same group of scan electrodes is scanned, thereafter the remaining groups of scan electrodes are scanned successively.

9. A driving method of effecting gradational display for a ferroelectric liquid crystal display device according to claim 3 wherein, using said ferroelectric liquid crystal display device capable of displaying M levels of tones with all the scan electrodes therein divided into groups of scan electrodes in a number of (1+M)/2 or less, a certain group of scan electrodes is scanned and subsequently the same group of scan electrodes is scanned, thereafter the remaining groups of scan electrodes are scanned successively.

10. A driving method of effecting gradational display for a ferroelectric liquid crystal display device according to claim 4 wherein, using said ferrolectric liquid crystal display device capable of displaying M levels of tones with all the scan electrodes therein divided into groups of scan electrodes in a number of (1+M)/2 or less, a certain group of scan electrodes is scanned and subsequently the same group of scan electrodes is scanned, thereafter the remaining groups of scan electrodes are scanned successively.

11. A driving method of effecting gradational display for a ferroelectric liquid crystal display device according to claim 5 wherein, using said ferroelectric liquid crystal display device capable of displaying M levels of tones with all the scan electrodes therein divided into groups of scan electrodes in a number of (1+M)/2 or less, a certain group of scan electrodes is scanned and subsequently the same group of scan electrodes is scanned, thereafter the remaining groups of scan electrodes are scanned successively.

12. A driving method of effecting gradational display for a ferroelectric liquid crystal display device according to claim 6 wherein, using said ferroelectric liquid crystal display device capable of displaying M levels of tones with all the scan electrodes therein divided into groups of scan electrodes in a number of (1+M)/2 or less, a certain group of scan electrodes is scanned and subsequently the same group of scan electrodes is scanned, thereafter the remaining groups of scan electrodes are scanned successively.

* * * * *